US007231925B1

(12) United States Patent
Wall

(10) Patent No.: US 7,231,925 B1
(45) Date of Patent: Jun. 19, 2007

(54) HAIR PICK

(76) Inventor: Albert Wall, 515 S. Cresent Ave., Lodi, CA (US) 95240

( * ) Notice: Subject to any disclaimer, the term of this patent is extended or adjusted under 35 U.S.C. 154(b) by 0 days.

(21) Appl. No.: 11/323,630

(22) Filed: Dec. 29, 2005

(51) Int. Cl.
*A45D 24/00* (2006.01)

(52) U.S. Cl. ..... 132/149; 132/156; 132/148

(58) Field of Classification Search ..... 132/149, 132/156, 154, 148, 219, 150, 146, 159, 160, 132/157, 144; D28/32, 31, 21
See application file for complete search history.

(56) References Cited

U.S. PATENT DOCUMENTS

| | | | | | |
|---|---|---|---|---|---|
| 2,199,282 | A | * | 4/1940 | Condron et al. | 132/149 |
| RE22,617 | E | * | 3/1945 | Huppert | 132/156 |
| 2,467,975 | A | * | 4/1949 | Hollen | 132/149 |
| 2,583,893 | A | * | 1/1952 | Shrosbree | 132/156 |
| D258,541 | S | | 3/1981 | Featherstone | |
| 4,345,608 | A | | 8/1982 | Cavaioli et al. | |
| D270,296 | S | | 8/1983 | Thomas | |
| 4,819,670 | A | * | 4/1989 | Saferstein et al. | 132/156 |
| 4,917,129 | A | * | 4/1990 | Olson | 132/161 |
| D330,782 | S | | 11/1992 | Balster et al. | |
| D368,981 | S | | 4/1996 | Bozak | |
| D441,136 | S | * | 4/2001 | Leman | D28/31 |

* cited by examiner

*Primary Examiner*—John J. Wilson
*Assistant Examiner*—Robyn Doan
(74) *Attorney, Agent, or Firm*—R. Michael West

(57) ABSTRACT

A hair pick comprising an elongated base member made from a material which is both flexible and resilient. A plurality of teeth project from an upper side of the base member. Finger engagement means is provided on the lower side of the base member, approximately midway between the base member's ends. Transversely oriented finger gripping means are provided on each of the base ends, having portions extending above and below the base member. With the base member in an unflexed state, the axes of the teeth are substantially parallel. When the hair pick is gripped, forces may be applied through the combination of the finger engagement means and the finger gripping means to flex the base member causing the teeth to be reoriented either into a converging closed position or a diverging open position.

21 Claims, 3 Drawing Sheets

HAIR PICK

BACKGROUND OF THE INVENTION

1. Field of the Invention

The invention relates generally to apparatus for grooming hair. More particularly, the invention pertains to a handheld hair pick having a flexible base member with a plurality of teeth extending therefrom, for lifting, holding and combing a shock of hair.

2. Description of the Prior Art

Hair picks and hair lift combs of various designs are well known in the art. The purpose of these devices is to facilitate lifting and combing a long shock of hair smoothly and repeatedly, to eliminate tangling and matting. For example, in U.S. Pat. No. 4,345,608 issued to Cavaioli et al., a hair lift comb having raised portions alternating on either side of adjacent comb teeth is shown. The '608 patent also shows a conventional comb back 10 to be gripped by the hairdresser during use of the comb.

A number of design patents have also issued for articles described as Hair Picks and Hair Lifts, including: Des. No. 368,981, issued to Bozak, for a Combined Hair Lift And Parting Out Tool; Des. 258,541, granted to Featherstone, for a Double Hair Pick; Des. 330,782, issued to Balster et al., for a Hair Pick; and, Des. 270,296, granted to Thomas, for a Hair Lifter.

However, all of these devices generally require the use of the hairdresser's second hand to hold and guide the hair through the teeth of the pick during the grooming operation. This requirement provides a disadvantage during grooming, as the hairdresser cannot use his or her other hand to perform associated procedures such as cutting or tinting the hair. It is an objective of the present invention, therefore, to provide a hair pick which can be held in one hand of the hairdresser, and manipulated through movement of that single hand, selectively to grip and release a shock of hair as needed during a grooming or treatment process for the hair.

SUMMARY OF THE INVENTION

The hair pick of the present invention comprises an elongated base member provided with a plurality of teeth projecting from an upper side of the base member. The base member is made from a material which is both flexible and resilient.

A finger ring is provided on the opposing lower side of the base member, approximately midway between first and second ends of the base member. The finger ring is sized and configured to accommodate the tip portion of the user's finger, typically the pointer finger.

Finger grips are provided on each of the base ends. In a first embodiment, the finger grips comprise outwardly extending arcuate segments. In a second embodiment, the finger grips are integrally molded within opposing lateral teeth. The finger grips are oriented generally transverse to the axis of the base member. The finger grips have portions extending above and below the base member, and preferably include an arcuate surface for comfortable engagement with a finger.

The hairdresser grasps the hair pick by passing his or her pointer finger into the finger ring, while the thumb and the middle finger engage a respective finger grip. By exerting inward or pushing pressure on the upper portions of the finger grip while pulling away from the base member using the finger ring, the base member is flexed into a first arcuate configuration and the axes of the teeth are reoriented inwardly to a closed position. In the closed position, the outer ends of the teeth may be touching, enabling the hairdresser to grip and hold a shock of hair.

By exerting inward pressure on the lower portions of the finger grip while pushing against the base member using the finger ring, the base member is flexed into a second arcuate configuration and the axes of the teeth are thereby reoriented outwardly into an open position. In the open position, the outer ends of the teeth are in spaced relation, separated from each other a greater distance than when the hair pick is in a rested position. The open position allows the hairdresser either to release a shock of hair, or to apply a minimum amount of friction to the shock during combing to minimize discomfort to the customer.

When the inward pressure on the finger grips is released, the resilient material used for the base member restores the hair pick to a rested or unflexed configuration, where the base member is lineal and axes of the teeth are generally in parallel relation. Through selective application and release of pressure on the finger grips, the hair pick can be manipulated with a single hand of the hairdresser to effect the desired combing, untangling, holding, and spraying of the hair shock.

DETAILED DESCRIPTION OF THE PREFERRED EMBODIMENT

Figure 1:
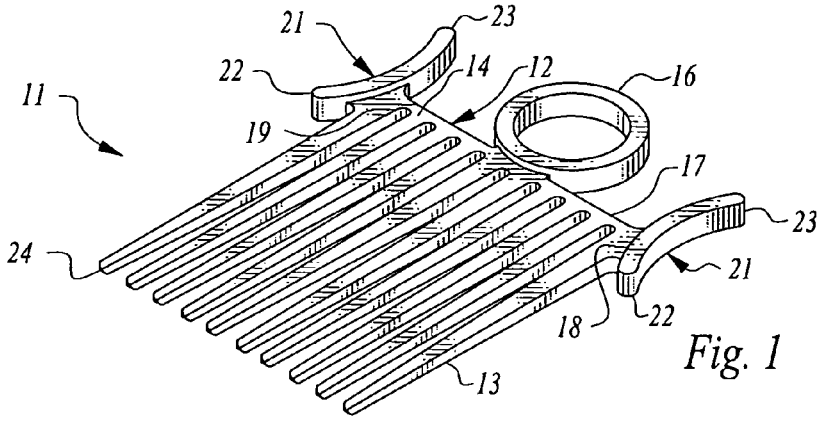
FIG. 1 is a perspective view of a first embodiment of the hair pick in an unflexed position, showing the centrally positioned finger ring and the laterally positioned finger grips.
Figure 2:
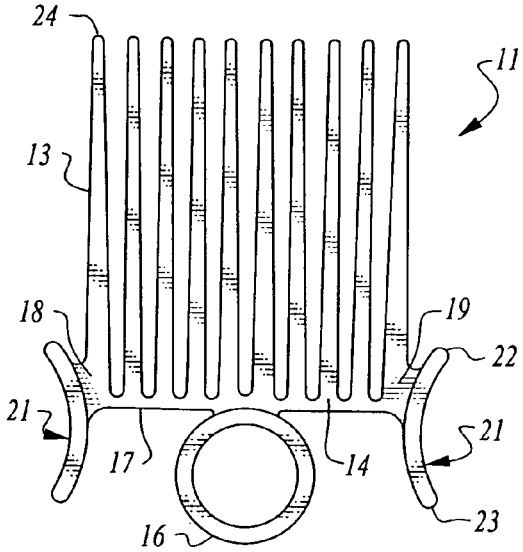
FIG. 2 is a front elevational view of the hair pick.

Turning now to the drawings, and in particular FIG. 1, the hair pick 11 of the present invention comprises an elongated base member 12 provided with a plurality of teeth 13 projecting from an upper side 14. Teeth 13 lie in a plane, and they are maintained in spaced relation from each other when pick 11 is in an unflexed state. The base member 12 is constructed from a material which is both flexible and resilient. In other words, it must be flexible enough so that it can be bent into an arcuate configuration through the application of selective forces, and resilient enough that it will self-restore to an unflexed, lineal configuration when those forces are released. It is also preferable that the hair pick 11 be integrally molded as a single piece, for ease of manufacture and for increased durability.

A finger engagement means 16 is provided on a lower side 17 of base member 12, lying in the same plane as opposing teeth 13. Engagement means 16 is located approximately midway between first end 18 and second end 19 of the base member, so that pushing or pulling forces can effectively be applied against the middle region of the base member. Finger engagement means 16 may conveniently be configured as a finger ring, as shown in the drawings. A ring has the advantage of accommodating a human index finger in such a way that both pushing and pulling forces may be applied. However, engagement means 16 may be formed as a tube, or configured other than right-circular in elevation and still receive a human finger to perform the desired function.

Finger gripping means 21 are provided on each of the base member ends 18 and 19. Gripping means 21 are oriented generally transverse to the longitudinal axis of base member 12, and lie in the same plane as teeth 13. Gripping means 21 preferably comprise arcuate concave segments, to ensure comfortable accommodation of the user's finger tips. Gripping means have an upper portion 22 extending above the base member and a lower portion 23 extending below the base member. Inward, or pushing forces may selectively be applied to lower portion 23 or upper portion 22, as shown respectively in FIGS. 6 and 7.

Figure 4:
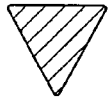
FIG. 4 is a transverse, cross-sectional view of an alternative hair pick tooth.
Figure 5:
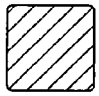
FIG. 5 is a transverse, cross-sectional view of another alternative hair pick tooth.
Figure 3:
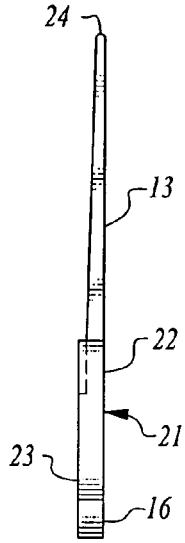
FIG. 3 is a side elevational view of the hair pick.

The teeth 13 preferably taper in size from base member 12 to tips 24. Teeth 13 may be any desired configuration in cross-section, including, for example, circular, triangular, or square. It may be desirable, where more aggressive gripping of the hair is needed, to use a configuration for the teeth 13 which exposes the hair stands to the sharp edges of different geometric shapes, such as shown in FIG. 4 or 5.

Figure 9:
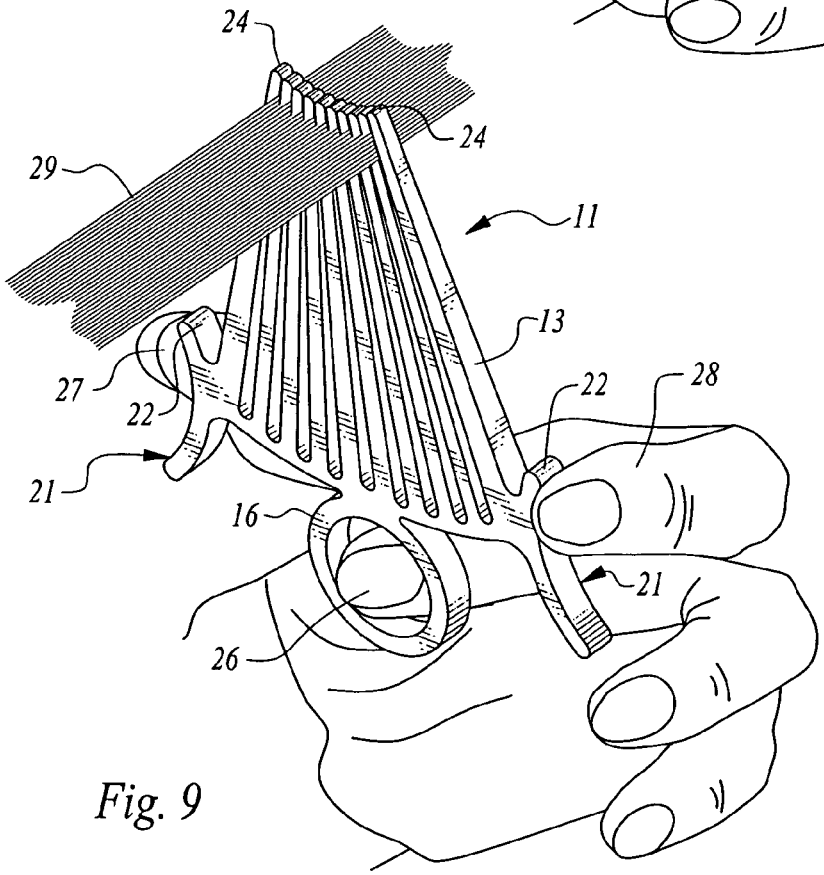
FIG. 9 is a perspective view of the hair pick in a closed position, tightly engaging a shock of hair.
Figure 10:
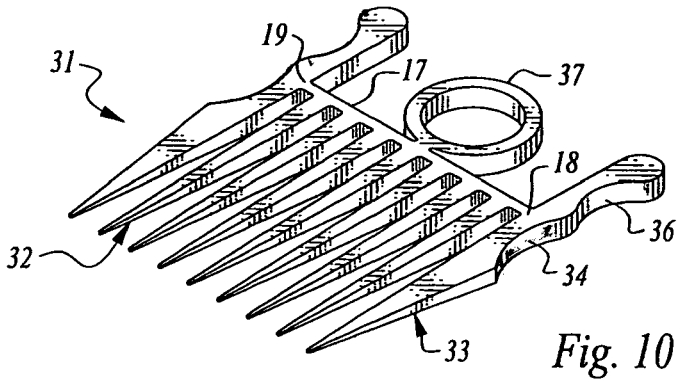
FIG. 10 is a perspective view of a second embodiment of the hair pick, including upper and lower finger grip recesses in opposing lateral teeth.

The hairdresser grasps the hair pick 11 by passing his or her pointer finger 26 into the finger engagement means 16, as shown in FIG. 9. The thumb 27 and the middle finger 28 engage the upper portions 22 of finger gripping means 21. By exerting inward pressure on the upper portions 22 of the finger grip while pulling away from the base member 12 using the finger engagement means 16, the base member 12 is flexed into a first arcuate configuration, shown in FIG. 7. In this first configuration, the axes of the teeth 13 are reoriented so that they inwardly converge into a closed position. In the closed position, the outer tips 24 of the teeth may be touching, enabling the hairdresser to grip and hold a shock of hair 29.

Figure 6:
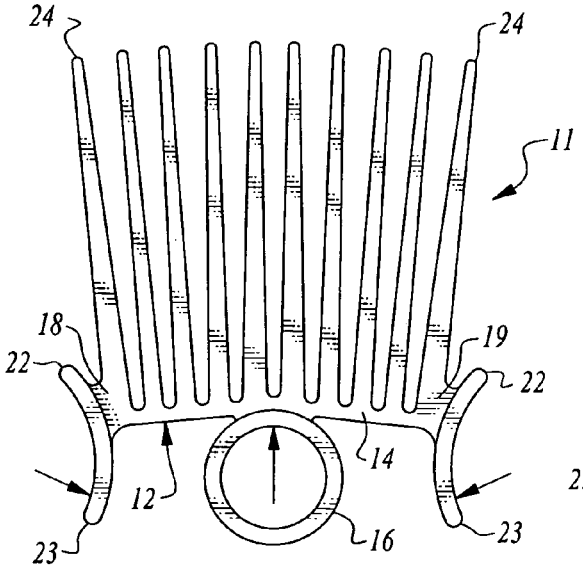
FIG. 6 is a front elevational view of the hair pick in an open position, the arrows indicating the location and direction of forces applied by the user's fingers.
Figure 7:
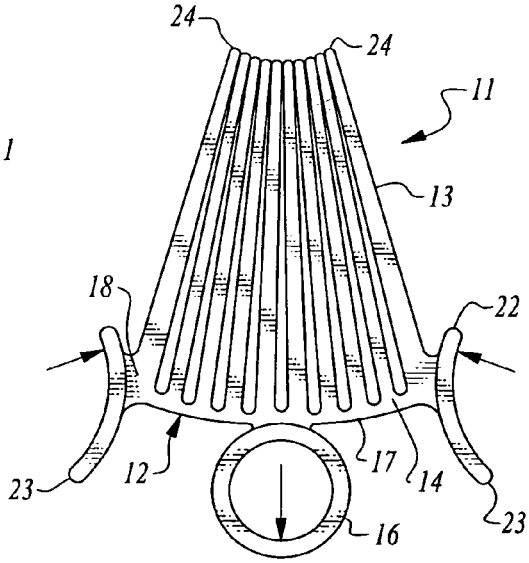
FIG. 7 is a front elevational view of the hair pick in a closed position, the arrows indicating the location and direction of forces applied by the user's fingers.
Figure 8:
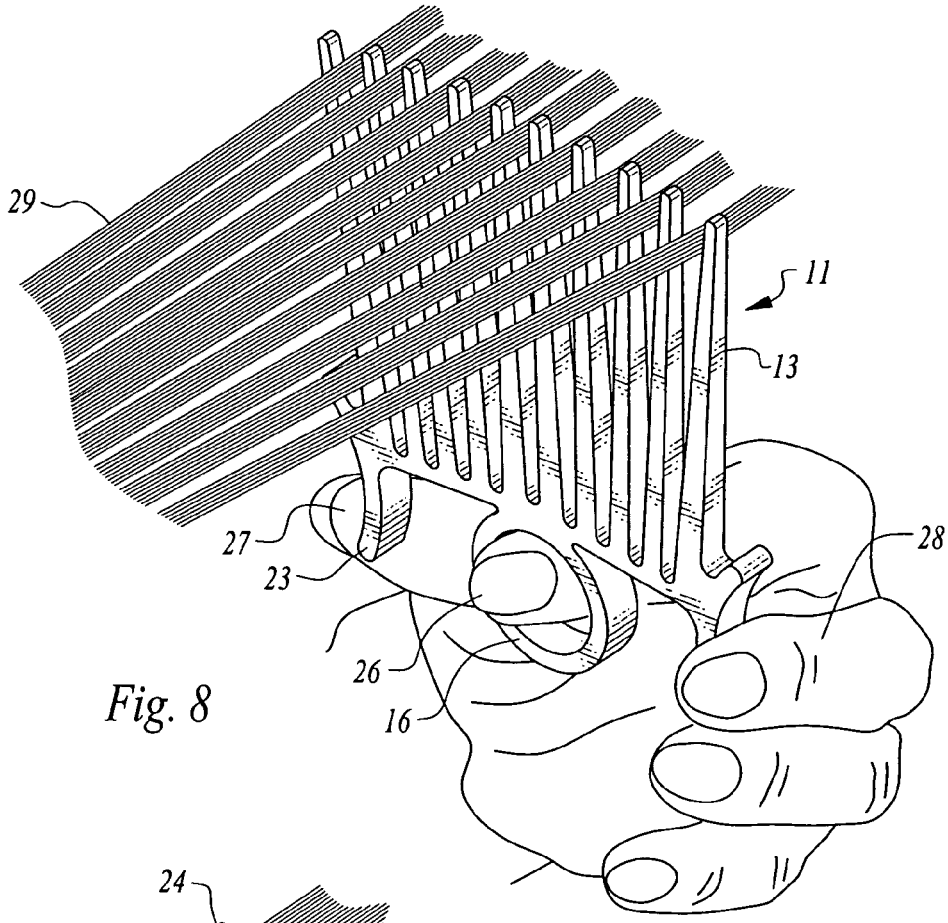
FIG. 8 is a perspective view of the hair pick in an open position, lightly engaging a shock of hair.

By exerting inward pressure on the lower portions 23 of the finger gripping means 21 while pushing against the base member 12 using the finger engagement means 16, the base member 12 is flexed into a second arcuate configuration, shown in FIG. 6. In this second configuration, the axes of the teeth 13 are reoriented so that they outwardly diverge into an open position. In the open position, the outer tips 24 of the teeth are in spaced relation, separated from each other a greater distance than when the hair pick is in an unflexed state. The open position allows the hairdresser either to release a shock of hair 29, or to apply a minimum amount of friction to the shock during combing to minimize discomfort to the customer.

When the inward pressure applied to the finger gripping means 21 is released, the resilient material used for the base member 12 restores the hair pick 11 to a rested, or unflexed state, where the axes of the teeth 13 are generally parallel in relation. Through selective application and release of pressure or forces on the finger engagement means and the finger gripping means, the hair pick 11 can be manipulated with a single hand of the hairdresser to effect the desired combing, untangling, and control of the hair shock 29.

A second embodiment of the invention, identified as hair pick 31, is shown in FIGS. 10 through 14. Because hair pick 31 shares most of the structural and operational features of hair pick 11, the same identification numerals as used previously will be used in the following discussion, where appropriate.

Figure 11:
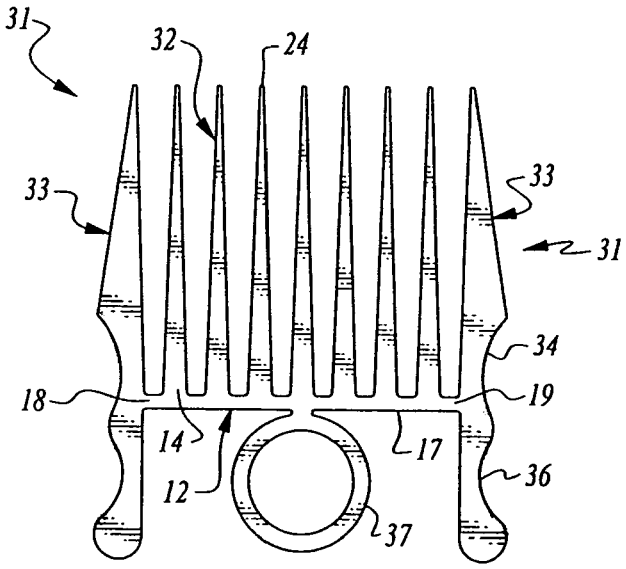
FIG. 11 is a front elevational view of the second embodiment.
Figure 12:
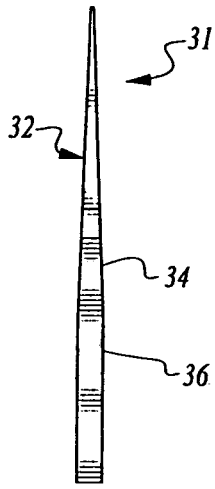
FIG. 12 is a side elevational view of the second embodiment.

Hair pick 31 includes a base member 12 and a plurality of intermediate teeth 32 extending from an upper side 14 of base member 12 and lying in a plane. Opposing lateral teeth 33 are provided on first end 18 and second end 19 of base member 12. Lateral teeth 33 are oriented generally transverse to base member 12, as shown in FIG. 11. Lateral teeth 33 are integrally molded with upper finger grip recesses 34 in a portion extending above the base member, and lower finger grip recesses 36 in a portion extending below the base member. A finger ring 37 extends from a lower side 17 of base member 12. Lateral teeth 33 and finger ring 37 lie in the same plane as intermediate teeth 32.

Figure 13:
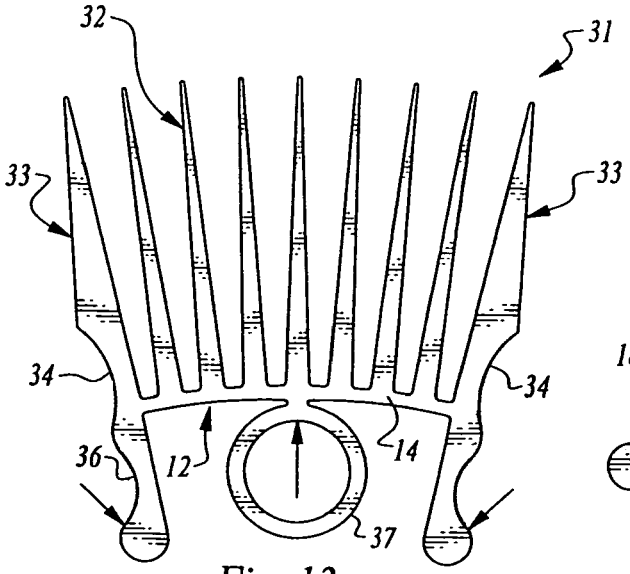
FIG. 13 is a front elevational view of the second embodiment in an open position, the arrows indicating the location and direction of forces applied by the user's fingers in the lower recesses and in the finger ring; and, FIG. 14 is a front elevational view of the second embodiment in a closed position, the arrows indicating the location and direction of forces applied by the user's fingers in the upper recesses and in the finger ring.
Figure 14:
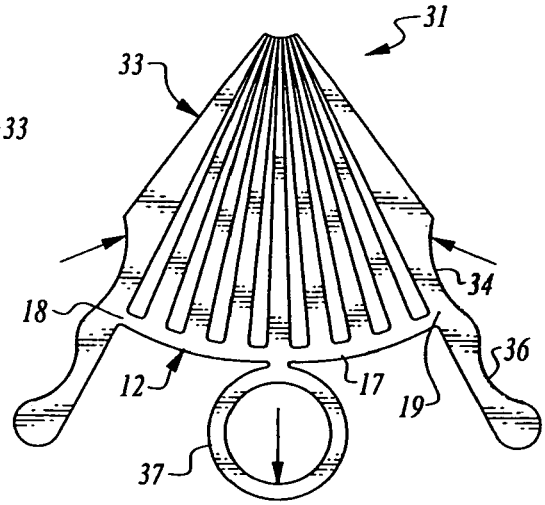

In operation, hair pick 31 functions and is used in a manner identical to that described for hair pick 11. The finger ring 37 is engaged by the user's pointer or index finger, and the lower finger grip recesses 36 are engaged by the user's thumb and middle fingers. As shown in FIG. 13, by exerting an upward pushing force on the finger ring, and by exerting inward pushing forces on the recesses 36, the base member is flexed into a first arcuate configuration. The teeth 32 are thereby reoriented into a diverging open position, either to engage or release a shock of hair. Then, by exerting a downward pushing force on the finger ring, and by exerting inward pushing forces on the recesses 34, the base member is flexed into a second arcuate configuration. The teeth 32 are thereby reoriented into a converging closed position, to lock or clamp onto a shock of hair.

Of course the user may select an intermediate open position or an intermediate closed position, merely by controlling the location and amount of forces applied to the pick 31. And, with no forces applied to the ring or the recesses, the pick 31 returns to an unflexed state where the base member is lineal in configuration and the teeth 32 are maintained in substantially parallel relation.

It will be appreciated, therefore, that I have disclosed two embodiments of a hair pick which is simple to operate, inexpensive to manufacture, and allows the hairdresser one-handed control over the engagement, disengagement, and grooming of a shock of hair.

What is claimed is:

1. A hair pick comprising:

a. an elongated base member made from a material which is flexible and resilient;

b. a plurality of teeth projecting from an upper side of said base member, said plurality of teeth lying in a plane in spaced relation from each other, when the pick is in an unflexed state;

c. a finger ring provided on a lower side of said base member, said finger ring being located approximately midway between first and second ends of said base member; and, d. lateral finger grips provided on said first end and said second end of said base member and oriented generally transverse thereto, said finger grips having portions extending above and below said base member, said finger ring and said lateral finger grips lying in said plane.

2. A hair pick as in claim 1 in which said teeth are elongated and generally right-circular cylindrical in cross-section.

3. A hair pick as in claim 1 in which said teeth are elongated and generally triangular in cross-section.

4. A hair pick as in claim 1 in which said teeth are elongated and generally square in cross-section.

5. A hair pick as in claim 1 in which said teeth have axes which are generally parallel when said pick is in an unflexed state.

6. A hair pick as in claim 1 in which said finger grips are arcuate in configuration, and inwardly concave in orientation with respect to said first and second ends of said base member.

7. A hair pick as in claim 1 in which said finger ring is circular and sized to accommodate a human finger passing therethrough.

8. A hair pick as in claim 1 in which said flexible and resilient material is plastic.

9. A hair pick as in claim 1 in which each of said teeth tapers in size from said base member to a respective tip.

10. A hair pick comprising:

a. an elongated base member made from a material which is flexible and resilient;

b. a plurality of elongated teeth projecting from an upper side of said base member to respective tips, said teeth lying in a plane in spaced relation from each other and having axes substantially parallel when said base member is in an unflexed state;

c. a finger ring provided on a lower side of said base member, said ring being located approximately midway between first and second ends of said base member and lying in said plane;

d. generally transverse lateral finger grips provided on said first end and said second end of said base member and lying in said plane, said finger grips having upper portions extending above said base member and lower portions extending below said base member, whereby exerting inward pressure on said upper portions of said finger grips and exerting downward pressure on said finger ring causes said base member to flex into a first configuration in which said axes and said tips of said teeth are reoriented inwardly to a closed position, and whereby exerting inward pressure on said lower portions of said finger grips and exerting upward pressure on said finger ring causes said base member to flex into a second configuration and said axes and said tips of said teeth are reoriented outwardly to an open position.

11. A hair pick as in claim 10 in which said teeth are elongated and generally right-circular cylindrical in cross-section.

12. A hair pick as in claim 10 in which said teeth are elongated and generally triangular in cross-section.

13. A hair pick as in claim 10 in which said teeth are elongated and generally square in cross-section.

14. A hair pick as in claim 10 in which said finger grips are arcuate in configuration, and inwardly concave in orientation with respect to said first and second ends of said base member.

15. A hair pick as in claim 10 in which said finger ring is circular and sized to accommodate a human finger passing therethrough.

16. A hair pick as in claim 10 in which said flexible and resilient material is plastic.

17. A hair pick as in claim 10 in which each of said teeth tapers in size from said base member to said respective tips.

18. A hair pick comprising:

a. an elongated base member made from a material which is flexible and resilient, said base member having first and second ends and an upper side and a lower side;

b. a plurality of teeth projecting from said upper side of said base member, said plurality of teeth lying in a plane in spaced relation from each other;

c. finger engagement means for directing pushing or pulling forces against said base member, said finger engagement means being provided on said lower side of said base member and being located approximately midway between said first and second ends of said base member; and, d. finger gripping means for directing pushing forces against said base member, said finger gripping means being provided on said first end and said second end of said base member and oriented generally transverse thereto, said finger gripping means having portions extending above and below said base member, said finger engagement means and said finger gripping means lying in said plane.

19. A hair pick as in claim 18 in which said finger engagement means comprises a ring.

20. A hair pick as in claim 18 in which said finger gripping means comprises concave arcuate segments.

21. A hair pick comprising:

a. an elongated base member made from a material which is flexible and resilient;

b. a plurality of teeth projecting from an upper side of said base member, said plurality of teeth lying in a plane in spaced relation from each other;

c. a finger ring provided on a lower side of said base member, said finger ring being located approximately midway between first and second ends of said base member and lying in said plane; and, d. opposing lateral teeth lying in said plane and provided on said first end and said second end of said base member and oriented generally transverse thereto, said lateral teeth having upper finger grip recesses in a portion of said lateral teeth extending above said base member, and lower finger grip recesses in a portion of said lateral teeth extending below said base member.

* * * * *